US006767299B1

(12) United States Patent
Chang

(10) Patent No.: US 6,767,299 B1
(45) Date of Patent: Jul. 27, 2004

(54) WOOD BASEBALL BAT

(76) Inventor: Jung-Shih Chang, No. 32, Lane 25, Li Min Street, Ta Li City, Taichung Hsien (TW)

( * ) Notice: Subject to any disclaimer, the term of this patent is extended or adjusted under 35 U.S.C. 154(b) by 0 days.

(21) Appl. No.: 10/615,030

(22) Filed: Jul. 9, 2003

(51) Int. Cl.[7] ..... A63B 59/06
(52) U.S. Cl. ..... 473/564; 473/519
(58) Field of Search ..... 473/564–568, 473/519, 520, 457

(56) References Cited

U.S. PATENT DOCUMENTS 1,665,195 A * 4/1928 Cohn ..... 473/520
2,379,006 A * 6/1945 Johnson ..... 473/568
2,458,919 A * 1/1949 Marsden ..... 473/564
3,116,926 A * 1/1964 Owen ..... 473/457
5,165,686 A * 11/1992 Morgan ..... 473/564
5,277,421 A * 1/1994 Rewolinski ..... 473/457
6,254,502 B1 * 7/2001 Becker ..... 473/594
6,280,353 B1 * 8/2001 Brundage ..... 473/457
6,334,823 B1 * 1/2002 Holman ..... 473/564
6,569,042 B2 * 5/2003 LaChance et al. ..... 473/457
6,682,447 B1 * 1/2004 Black ..... 473/457
6,692,386 B2 * 2/2004 Brundage ..... 473/457

* cited by examiner

*Primary Examiner*—Mark S. Graham
(74) *Attorney, Agent, or Firm*—Browdy and Neimark, P.L.L.C.

(57) ABSTRACT

A baseball bat includes a wood bat body having a longitudinally extended center through hole, and a tubular core member made of composite material, metal or plastics and fitted into the center through hole of the bat body. The tubular core member has two inner threads in the two ends thereof. Two weights are respectively threaded into the inner threads in the two ends of the core member such that the weights are movable along an axial direction of the core member when the weights are driven to rotate by an external force so as to adjust the center of gravity of the baseball bat.

9 Claims, 2 Drawing Sheets

WOOD BASEBALL BAT

BACKGROUND OF THE INVENTION

1. Field of the Invention

The present invention relates generally to a wood baseball bat and, more particularly, to a high-strength and high-performance wood baseball bat, which allows the user to adjust the center of gravity thereof.

2. Description of the Related Art

Regular baseball bats include wood baseball bats and metal (aluminum) baseball bats. Using a wood baseball bat requires a higher batting skill than a metal baseball bat. However, some people prefer to use a wood baseball bat rather than a metal baseball bat because of the unique outer appearance of the wood baseball bat and the sound produced upon hitting against the ball.

However, a wood baseball bat has two major drawbacks that should be improved. One drawback of a wood baseball bat is its weak structural strength. The other drawback of a wood baseball bat is its poor batting performance (less power and not easy to control the hitting point).

Further, the center of gravity of a wood baseball bat is determined subject to its material and size (length and thickness). Because a conventional wood baseball bat is made of natural wood, it is difficult to control the density of the bat (either made of a wooden block by a lathe, or formed of wooden strips by compression). Wood baseball bats of the same size and same material may have a different center of gravity. The center of gravity different makes quality control difficult. Further, wood baseball bats made according to conventional techniques have their center of gravity limited to a narrow segment. Making a wood baseball bat having its center of gravity beyond such a narrow segment needs to change the size or proportion. The aforesaid drawbacks limit the flexibility in product design.

SUMMARY OF THE INVENTION

The present invention has been accomplished under the circumstances in view. It is the primary objective of the present invention to provide a wood baseball bat, which has a strong structural strength, and does not break easily.

It is another objective of the present invention to provide a wood baseball bat, which provides a great moment when hitting the ball, and has a broad sweet spot for better performance.

It is still another objective of the present invention to provide a wood baseball bat, which allows adjustment of the center of gravity.

To achieve these objectives of the present invention, the baseball bat comprises a wood bat body having a handle at a first end thereof, a ball-hitting portion at a second end thereof, and a center through hole axially extended the first and second ends; a tubular core member made of a material selected from a group consisting of composite material, metal and plastics and fitted into the center through hole of the bat body, the core member having an inner thread corresponding in location to the ball-hitting portion of the bat body and a length shorter than the bat body; and a weight mounted inside the tubular core member and having an outer thread threadedly engaged with the inner thread of the core member such that the weight is movable along an axial direction of the core member when the weight is driven to rotate by an external force.

DETAILED DESCRIPTION OF THE INVENTION

Figure 1:
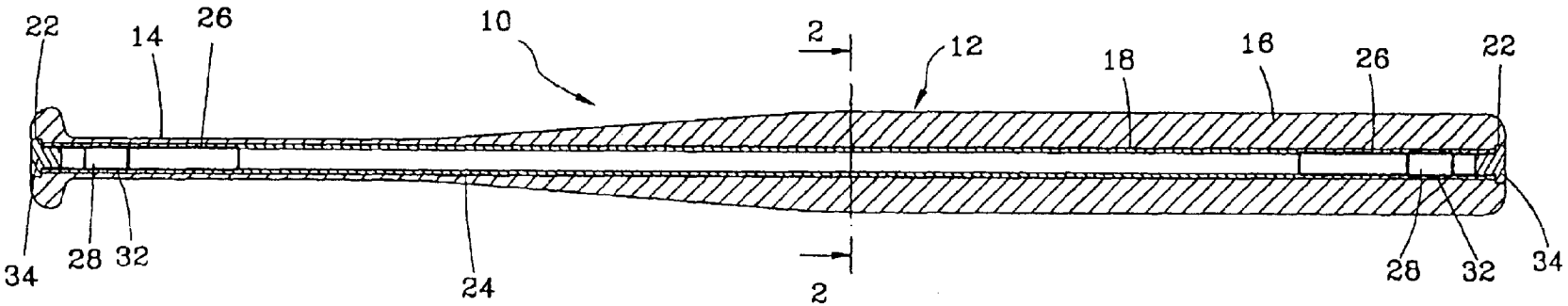
FIG. 1 is a longitudinal sectional view of a wood baseball bat according to a first preferred embodiment of the present invention.
Figure 2:
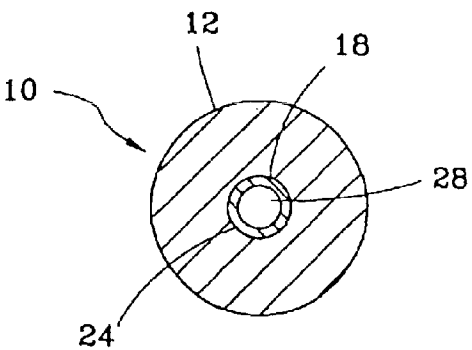
FIG. 2 is a cross-sectional view taken along line 2—2 of FIG. 1.

Referring to FIGS. 1 and 2, a wood baseball bat 10 is shown comprised of a bat body 12, a tubular core member 24, two weights 28, and two end plugs 34.

The bat body 12 is a bar of wood having a relatively thinner handle 14 at one end and a relatively thicker ball-hitting portion 16 at the other end. The total length of the bat body 12 is about 32~35 inches. The diameter of the handle 14 is about ⅞~1 inch. The diameter of the ball-hitting portion 16 is about 2~2.5 inches. The aforesaid bat body size is the best choice; however it is not the limitation. The bat body 12 has a center through hole 18 axially extended through the two distal ends. According to this embodiment, the center through hole 18 has a uniform circular cross section. The diameter of the center through hole 18 is about ¾ inch. The bat body 12 further has two circular recesses 22 at the two distal ends around the center through hole 18.

The tubular core member 24 is made of compound material (for example, carbon fibers). Alternatively, the tubular core member 24 can be made of metal, rigid plastics, or the like. The tubular core member 24 is shaped like a straight round tube, having a length slightly shorter than the axial length of the bat body 12 and an outer diameter fitting the diameter of the center through hole 18 of the bat body 12 (i.e., about ¾ inch). The tubular core member 24 is fitted into the center through hole 18 of the bat body 12, keeping the two distal ends spaced from the two distal ends of the bat body 12 by a gap. According to this embodiment, the distal ends of the tubular core member 24 are respectively disposed in flush with the inner side (bottom wall) of the circular recesses 22. The tubular core member 24 has two inner threads 26 respectively extended in the two ends.

The weights 28 are metal cylindrical members, each having an outer thread 32 extended around the periphery.

The weights 28 are respectively mounted in the tubular core member 24 and screwed up with the inner threads 26. The screw joint between the weights 28 and the tubular core member 24 is properly adjusted to prevent rotary motion of the weights 28 relative to the tubular core member 24 upon batting of the bat body 12. Each weight 28 further has a tool groove (not shown) disposed at an outer side (for the right-sided weight, the tool groove is disposed at the right side) for the positioning of a driving tool used to turn each weight 28 forwards/backwards along the corresponding inner thread 26 in the tubular core member 22. The tool groove can be a straight groove, crossed groove, or hexagonal groove for the positioning of a keystone tip screwdriver, Phillips head tip screwdriver, or hex wrench.

The end plugs 34 are wooden members (preferably of the same wooden material for the bat body 12) bonded to the circular recesses 22 in flush with the distal ends of the bat body 12 to seal the distal ends of the center through hole 18.

The wood baseball bat 10 has features and advantages as follows:

1. Similar to a conventional wood baseball bat, the wood baseball bat 10 has the same wooden appearance quality and produces the same sound when hitting the ball.
2. The insertion of the tubular core member in the axially extended center through hole of the bat body greatly reinforces the structural strength of the wood baseball bat to prolong its service life. The wood baseball bat does not break easily like conventional wood baseball bats when hitting the ball.
3. During production, the maker can use a tool to rotate the weights in the tubular core member to further adjust the center of gravity of the wood baseball bat (according to the aforesaid embodiment, the center of gravity of the wood baseball bat can be adjusted within the range of 10.5~14.5 inches from the front end of the bat body). Therefore, the maker can calibrate the center of gravity of the wood baseball bats of the same lot as desired, preventing a variation of product performance due to wooden material density difference. The maker can also adjust same size wood baseball bats into different groups having different center of gravity. Therefore, the maker can provide a broad specification range without increasing the manufacturing cost. Further, the invention breaks the constrained relationship between size and center of gravity in conventional wood baseball bats, providing multiple choices to users.
4. The arrangement of the weights in the front and rear ends of the bat enables the bat to have a relatively broader sweat spot and to produce a relatively greater moment when hitting the ball. Therefore, the user can bat the ball with the sweet spot easily to drive the ball to fly faster and farther.

It is to be understood that the bat body of the present invention can be cut from a solid wooden block by a lathe (and then drill the desired center through hole for the mounting of the tubular core member). Alternatively, the bat body can be made in the same way as the conventional "compressive wood baseball bat" by means of fastening wooden strips to the periphery of the tubular core member by adhesive and compression.

Figure 3:
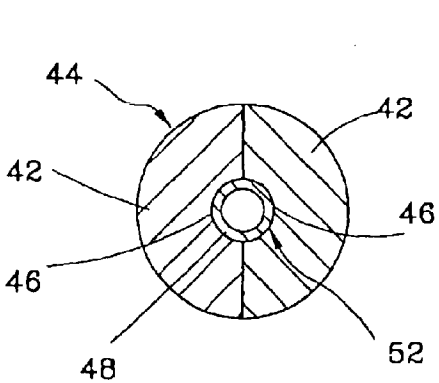
FIG. 3 is similar to FIG. 2 and shows a cross-sectional view of a wood baseball bat according to a second preferred embodiment of the present invention.

FIG. 3 is a cross sectional view of an alternate form of the wood baseball bat according to the present invention. According to this embodiment, the bat body 44 is formed of two semicircular wooden bars 42. The two semicircular wooden bars 42 each have a longitudinal groove 46. When the semicircular wooden bars 42 bonded together, the longitudinal grooves 46 form a circular center through hole 52, which accommodates the tubular core member, referenced by 48. During fabrication, the tubular core member 48 is put in between the semicircular wooden bars 42, and then the semicircular wooden bars 42 are bonded together.

Figure 4:
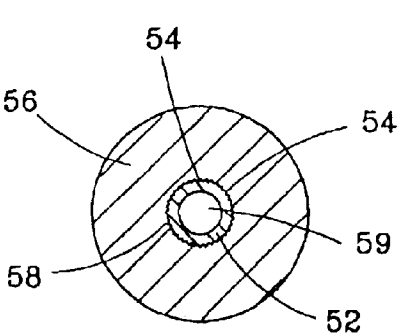
FIG. 4 is similar to FIG. 2 and shows a cross-sectional view of a wood baseball bat according to a third preferred embodiment of the present invention.

FIG. 4 is a cross sectional view of another alternate form of the wood baseball bat according to the present invention. According to this embodiment, the tubular core member 52 has a plurality of longitudinal ribs 54 equiangularly spaced around the periphery and stopped against the peripheral wall of the center through hole 58 of the bat body 56. The cross-section of the tubular core member 52 is shaped like a gear. This design of tubular core member 52 greatly reinforces the structural strength of the wood baseball bat. Further, the engagement between the longitudinal ribs 54 of the tubular core member 52 and the peripheral wall of the center through hole 58 prevents biasing of the tubular core member 52 when rotating the weights 59 to adjust the center of gravity of the wood baseball bat.

Figure 5:
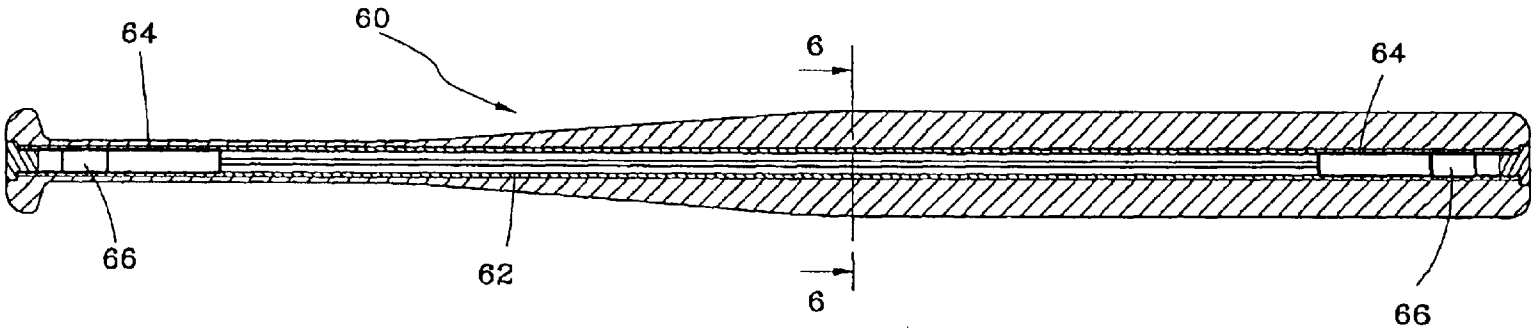
FIG. 5 is a longitudinal sectional view of a wood baseball bat according to a fourth preferred embodiment of the present invention.
Figure 6:
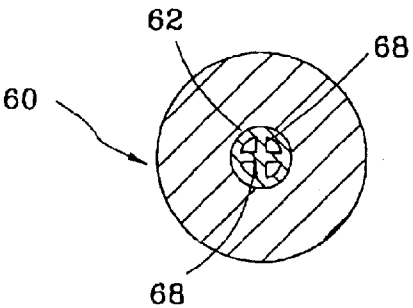
FIG. 6 is a cross-sectional view taken along line 6—6 of FIG. 5.

FIGS. 5 and 6 show still another alternate form of the wood baseball bat according to the present invention. According to this embodiment, the tubular core member 62 of the wood baseball bat 60 is extruded from aluminum, having two inner threads 64 in the two rounded ends of the inner diameter and radial ribs 68 supported on the inside and extended in longitudinal direction. According to this embodiment, there are four radial ribs 68 connected together, forming a crossed support to reinforce the structural strength of the tubular core member 62. In addition, a solid cylindrical core member having two rounded hollow ends for receiving the weights may be used to substitute for the tubular core member.

Figure 7:
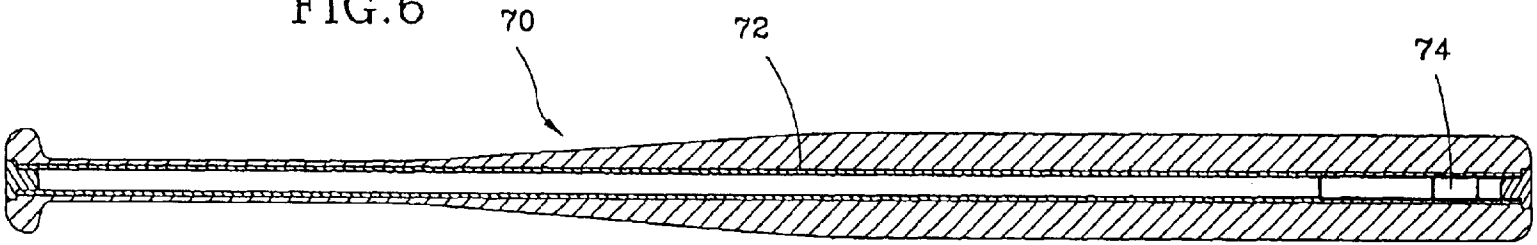
FIG. 7 is a longitudinal sectional view of a wood baseball bat according to a fifth embodiment of the present invention.

FIG. 7 shows still another alternate form of the wood baseball bat according to the present invention. According to this embodiment, there is only one weight 74 mounted in the front end of the tubular core member 72 of the wood baseball bat 70. The rear end of the tubular core member 72 is not provided with a weight. This embodiment achieves also the advantages of reinforcing the structural strength, improving the batting performance, and allowing adjustment of the center of gravity.

What is claimed is:

1. A baseball bat comprising:

a wood bat body having a handle at a first end thereof, a ball-hitting portion at a second end thereof, and a center through hole axially extended the first and second ends;

a tubular core member made of a material selected from a group consisting of composite material, metal and plastics and fitted into the center through hole of said bat body, said core member having an inner thread corresponding in location to said ball-hitting portion of said bat body and a length shorter than said bat body; and a weight mounted inside said tubular core member and having an outer thread threadedly engaged with the inner thread of said core member such that the weight is movable along an axial direction of said core member when the weight is driven to rotate by an external force.

2. The baseball bat as claimed in claim 1, wherein said tubular core member has another inner thread corresponding in location to the handle of said bat body, and another weight having an outer thread is threadedly engaged with the another inner thread of said core member.

3. The baseball bat as claimed in claim 1, wherein said core member is made of composite material containing carbon fibers.

4. The baseball bat as claimed in claim 1, wherein said core member has a plurality of longitudinal ribs extended around an outer periphery thereof.

5. The baseball bat as claimed in claim 1, wherein said core member has inside radial ribs disposed beyond the inner thread of said core member.

6. The baseball bat as claimed in claim 1, further comprising two end plugs respectively fastened to two distal ends of said center through hole of said bat body.

7. The baseball bat as claimed in claim 6, wherein said end plugs are wooden end plugs.

8. The baseball bat as claimed in claim 1, wherein said bat body is formed of a plurality of wooden blocks abutted against one another around said core member.

9. The baseball bat as claimed in claim 5, wherein said bat body is formed of a plurality of wooden strips by adhesive and compression.

* * * * *